US005453775A

United States Patent [19]

Eguchi et al.

[11] Patent Number: 5,453,775

[45] Date of Patent: Sep. 26, 1995

[54] MEDICAL IMAGE FORMING APPARATUS

[75] Inventors: Hiroshi Eguchi; Minoru Furuse; Satoru Kawai, all of Tokyo, Japan

[73] Assignee: Dai Nippon Printing Co., Ltd., Japan

[21] Appl. No.: 274,779

[22] Filed: Jul. 14, 1994

Related U.S. Application Data

[62] Division of Ser. No. 983,167, Nov. 30, 1992, Pat. No. 5,354,725.

[30] Foreign Application Priority Data

Nov. 29, 1991 [JP] Japan ..... 3-339442
Feb. 14, 1992 [JP] Japan ..... 4-59272

[51] Int. Cl.[6] ..... B41J 2/325

[52] U.S. Cl. ..... 347/176; 347/183; 347/186; 346/33 ME

[58] Field of Search ..... 346/33 ME, 76 PH, 346/76 L; 400/120; 503/227; 428/195, 212, 341, 913, 914; 347/171, 174, 176, 172, 183, 184

[56] References Cited

U.S. PATENT DOCUMENTS 4,621,271 11/1986 Brownstein ..... 346/76 PH
4,786,917 11/1988 Hauschild et al. ..... 346/76 PH
5,260,255 11/1990 Sudo et al. ..... 503/227
5,354,725 10/1994 Eguchi et al. ..... 503/227

*Primary Examiner*—Huan H. Tran
*Attorney, Agent, or Firm*—Parkhurst, Wendel & Rossi

[57] ABSTRACT

A medical image forming method including, the steps of superposing a three-primary-color thermal transfer sheet and an image receiving sheet, the thermal transfer sheet having a base film and three color dye layers of yellow, magenta, and cyan, each of the dye layer; being composed of a dye and a binder, the image receiving sheet having a dye accepting layer heating the rear surface of the thermal transfer sheet with a heating device in an image shape; and driving and controlling the heating device with a control unit so as to form a full color image on the image receiving sheet. The control unit is adapted to compensate tones of the image so that chromaticity values thereof formed on the image receiving sheet are in a region defined by four points of (a*=0, b*=0), (a*=20, b*=−5), (a*=18, b*=15), and (a*=0, b*=15) when an achromatic color signal is input and L*=80. According to an aspect of the present invention, the control unit is adapted to compensate tones of three primary colors so that the density graduation of light red of an image in accordance with a light red signal sent to the control unit becomes high and thereby the low density region (light region) of the image formed in accordance with a achromatic color signal becomes reddish. According to another aspect of the present invention, since the dye layers are formed so that the light region becomes reddish and the dark region greenish, images where colors from light orange to light red can be easily distinguished are formed.

4 Claims, 2 Drawing Sheets

MEDICAL IMAGE FORMING APPARATUS

This is a division of application Ser. No. 07/983,167 filed Nov. 30, 1992 U.S. Pat. No. 5,354,725.

BACKGROUND OF THE INVENTION

1. Field of the Invention

The present invention relates to a medical image forming method and a forming apparatus of the same, in particular, to a forming method of clearly readable medical images of the surfaces of living tissues (such as the mouth, esophagus, and stomach walls) of a human body with sublimating dyes (thermal transfer dies) through an endoscope or the like.

2. Description of the Related Art

As the needs of full-color prints increase, a variety of thermal transfer techniques have been developed. As an example of these techniques, thermosensitive sublimating transfer technique for transferring sublimating dyes as color materials held on a base film such as a polyester film to an image receiving sheet on which a synthetic resin such as polyester is coated is known. In this technique, the amount of energy supplied to a heating device (for example, a thermal head and a laser), which heats the rear surface of a thermal transfer sheet, is adjusted in accordance with electric signals (image signals) received from an endoscope or the like, thereby controlling the transferring amount of dyes to an image receiving sheet. When three types of dyes (three primary colors of yellow, magenta, and cyan) are used and the thermal transfer process is performed three times, a multi-tone full color image can be obtained.

In this thermal transfer technique, since the thermal transfer efficiency depends on the color materials, when image signals are converted into thermal energy to be supplied to the heating device, compensations for these color materials are performed.

In conventional image forming apparatuses according to this technique, the amount of thermal energy of each of the three primary colors is adjusted and their tones are compensated so that an achromatic color image can be formed in accordance with an achromatic color signal being input.

When images of the surfaces of living tissues such as the mouth, esophagus, and stomach walls are formed, red color is much more frequently used than other colors due to the property of the living tissues. Moreover, in the clinical situation, medical doctors tend to diagnose the diseases of patients based on delicate changes of red color. Thus, the reproduction of red color is very important.

However, in images obtained by the conventional tone compensations, the low density region of red color was not satisfactory. Therefore, the medical doctors could not precisely diagnose diseases of their patients with these images.

SUMMARY OF THE INVENTION

An object of the present invention is to provide a medical image forming method with high reproducibilities of light red and tones.

An aspect of the present invention is a medical image forming method comprising the steps of superposing a three-primary-color thermal transfer sheet and an image receiving sheet, the thermal transfer sheet having a base film and three color dye layers of yellow, magenta, and cyan, each of the dye layer being composed of a dye and a binder, the image receiving sheet having a dye accepting layer, carrying out heat printing in accordance with image information, and driving and controlling the heating device with a control unit so as to form a full color image on the image receiving sheet, wherein the control unit is adapted to compensate tones of the image so that chromaticity values thereof formed on the image receiving sheet are in a region defined by four points of ($a^*=0$, $b^*=0$), ($a^*=20$, $b^*=-5$), ($a^*=18$, $b^*=15$), and ($a^*=0$, $b^*=15$) when an achromatic color signal is input and $L^*=80$.

Another aspect of the present invention is a medical image forming apparatus, comprising a heating device for heating the rear surface of a three-primary-color thermal transfer sheet in an image shape and for forming a full color image on an image receiving sheet, the thermal transfer sheet having a base film and three color dye layers of yellow, magenta, and cyan, each of the dye layer being composed of a dye and a binder, and a control unit for driving and controlling the heating device in accordance with an input image signal, wherein the control unit is adapted to compensate tones of the image so that chromaticity values thereof formed on the image receiving sheet are in a region defined by four points of ($a^*=0$, $b^*=0$), ($a^*=20$, $b^*=-5$), ($a^*=18$, $b^*=15$), and ($a^*=0$, $b^*=15$) when an achromatic color signal is input and $L^*=80$.

A further aspect of the present invention is a thermal transfer sheet having a base film and at least three dye layers of yellow, magenta, and cyan, the dye layers being layered on the base film, wherein the back surface of the thermal transfer sheet is adapted to be heated by a heating device driven and controlled by a control unit so as to form a full color image on an image receiving sheet, and wherein chromaticity values of an image formed on the image receiving sheet are in a region defined by four points of ($a^*=0$, $b^*=0$), ($a^*=20$, $b^*=-5$), ($a^*=18$, $b^*=15$), and ($a^*=0$, $b^*=15$) when an achromatic color signal is input to the control unit and $L^*=80$ or in another region defined by four points of ($a^*=0$, $b^*=20$), ($a^*=0$, $b^*=-10$), ($a^*=-20$, $b^*=-20$), and ($a^*=-20$, $b^*=15$) when an achromatic color signal is input to the control unit and $L^*=20$.

According to the present invention, the bright region of an image becomes reddish and the dark region thereof greenish. Thus, the light red can be easily distinguished. As a result, the surfaces of reddish living tissues such as the mouth, esophagus, and stomach walls of a human body can be precisely reproduced.

These and other objects, features and advantages of the present invention will become more apparent in light of the following detailed description of a best mode embodiment thereof, as illustrated in the accompanying drawings.

DESCRIPTION OF PREFERRED EMBODIMENTS

First Embodiment

Basic Composition

Figure 1:
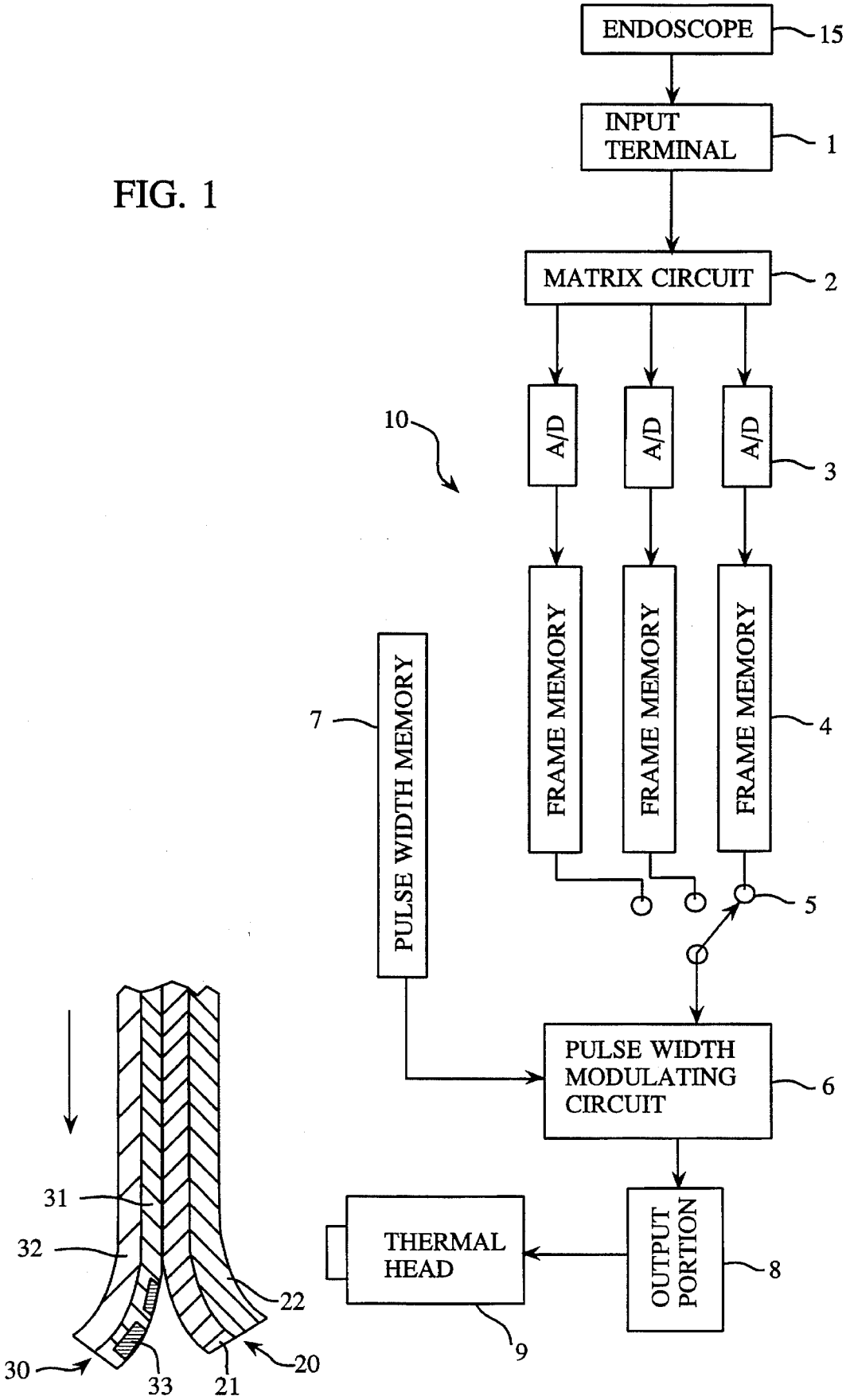
FIG. 1 is a block diagram showing a medical image forming apparatus in accordance with the present invention.
Figure 2:
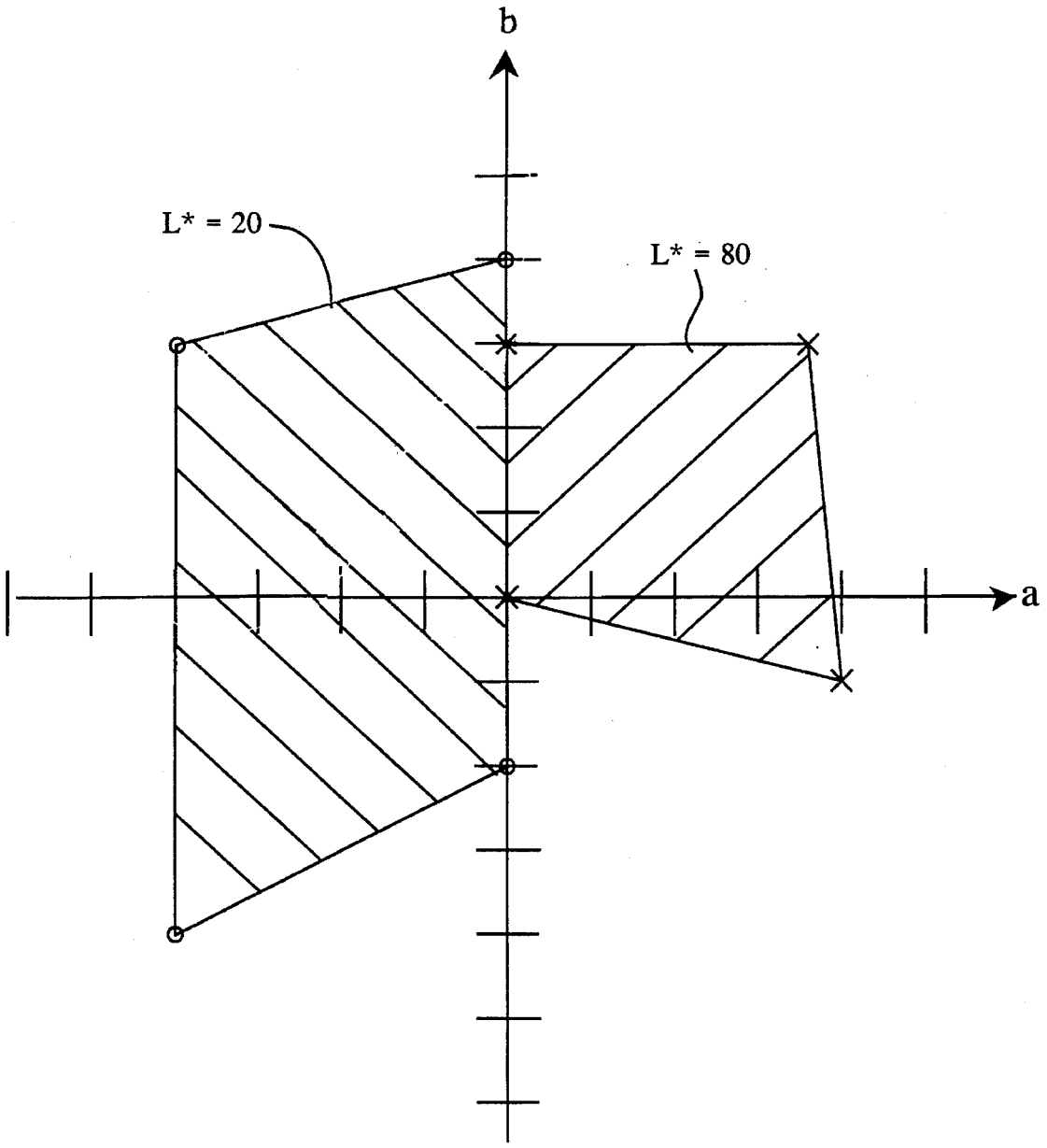
FIG. 2 is a schematic diagram showing chromaticity values of an image formed on an image receiving sheet.

Next, with reference to the accompanying drawings, an embodiment of the present invention will be shown. FIGS. 1 and 2 shows a first embodiment of the present invention. In FIG. 1, a thermal transfer sheet 20 and an image receiving sheet 30 are layered. The thermal transfer sheet 20 comprises a base film 22 (such as a polyester film) and dye layers 21 for three primary colors (yellow, magenta, and cyan). Each dye layer 21 consists of a corresponding dye (yellow, magenta, or cyan) and a corresponding binder. The dye layers 21 are successively layered on the front surface of the base film 22. The image receiving sheet 30 comprises a base sheet 32 and a dye accepting layer 31. On the front surface of the base sheet 32, the dye accepting layer 31 is disposed.

On the back surface of the thermal transfer sheet 20 (on the base film 22 side), a thermal head 9 which heats the thermal transfer sheet 20 is disposed. This thermal head 9 is driven and controlled by a control unit 10. The back surface of the thermal transfer sheet 20 is heated by the thermal head 9 in accordance with the shape of an image. By repeating the heating process for the three primary color dye layers of the thermal transfer sheet 20, a full color image 33 can be formed on the dye accepting layer 31 of the image receiving sheet 30.

In FIG. 1, reference numeral 1 is an image signal input terminal. Electric signals (image signals) of a color image received from an electronic camera of an endoscope 15, a video tape recorder, or the like are supplied to the image signal input terminal 1. Reference numeral 2 is a matrix circuit. The matrix circuit 2 decomposes the color image signals received from the input terminal 1 into three primary color (yellow, magenta, and cyan) components on the pixel-by-pixel basis. Each decomposed color component is stored in an individual frame memory 4 through an individual A/D converting circuit 3. Thereafter, by a color selecting switch 5, one of the three primary colors is selected. Thus, the relevant frame memory 4 is connected to a pulse width modulating circuit 6. The pulse width modulating circuit 6 reads compensation data in accordance with the relevant color from the corresponding pulse width memory 7 and compensates the pulse width of the color component (namely, compensates the tone of the color component). The resultant color component is sent from the pulse modulating circuit 6 to an output portion 8. The output portion 8 drives and controls the thermal head 9, thereby reproducing a desired full color image on the image receiving sheet 30.

The control unit 10 comprises the input terminal 1, the matrix circuit 2, the A/D converting circuits 3, the frame memories 4, the color selecting switch 5, the pulse width modulating circuit 6, the pulse width memory 7, and the output portion 8.

According to the present invention, since data received from the pulse width memory 7 is optimized and the chromaticity range of the image 33 formed on the image receiving sheet 30 is specifically designated, excellent medical images can be obtained.

In other words, when an achromatic color signal is sent to the input terminal 1 of the control unit 10, the control unit 10 optimizes data received from the pulse width memory 7, compensates the tones in a region defined by four points of (a*=0, b*=0), (a*=20, b*=−5), (a*=18, b*=15), and (a*=0, b*=15) in the case L*=80 and in a region defined by four points of (a*=0, b*=20), (a*=0, b*=−10), (a*=−20, b*=−20), and (a*=−20, b*=15) in the case L*=20, and adjusts the thermal head 9.

FIG. 2 shows the chromaticity values in accordance with JIS-Z8722 and JIS-Z8730 (JIS stands for Japanese Industrial Standard). In particular, JIS-Z8730 defines CIE1976.

According to JIS-Z8722 and JIS-Z8730, chromaticity values are represented with three values L*, a*, and b*. L* represents lightness. As the value of L* increases, the lightness becomes strong. a* represents the degree of red. As the value of a* increases, the degree of red becomes strong. When the value of a* is minus, green appears instead of red. b* represents the degree of yellow. As the value of b* increases, the degree of yellow becomes strong. When the value of b* is minus, blue appears instead of yellow. When both the values of a* and b* are zero, achromatic color appears.

Next, with specific examples and their comparisons, the present invention will be described in detail.

Examples (Nos. 1 to 20) and Comparisons (Nos. 21 to 26)

With three-color (yellow, magenta, and cyan) thermal transfer sheets and image receiving sheets which were commercially available, images were formed by a test printer having a thermal head.

300 sets of data for the pulse width memory were prepared. Each of the prepared data was sent directly to the pulse width modulating circuit, not through the pulse width memory. With the same data as the pulse width memory (after the same tone compensation was performed), the following three types of images were formed on the image receiving sheets. In other words, in accordance with image signals from the input terminal, the same tone compensation was performed by the control unit, thereby forming three types of images.

Image 1: 256 tones of achromatic color

Image 2: Video input image of esophagus by endoscope

Image 3: Video input image of pyloric region of stomach by endoscope

Evaluation Method

Image 1: With a spectral color difference meter CM-1000 (made by Minolta K. K.), the chromaticity values L*, a*, and b* of CIE for the image 1 were measured.

Images 2 and 3: Under the following criteria, the images 2 and 3 were visually measured.

◎: Very clear. Details of tissue could be easily distinguished.

○: Clear. Details of tissue could be distinguished.

Δ: Somewhat unclear. Details of tissue were distinguished with difficulty.

x: Completely unclear. Details of tissue could not be distinguished.

The results of this evaluation are shown in the following table.

TABLE 1

| | Image 1 | | | | | |
|---|---|---|---|---|---|---|
| | When L* is about 80 | | When L is about 20 | | Image | Image |
| No. | a* | b* | a* | b* | 2 | 3 |
| 1 | 12.08 | 1.96 | −4.28 | −10.31 | ◎ | ◎ |
| 2 | 18.63 | −3.02 | −4.10 | −6.52 | ◎ | ◎ |
| 3 | 11.78 | 11.43 | −8.31 | −18.26 | ◎ | ◎ |
| 4 | 4.05 | 3.93 | −12.00 | −16.06 | ◎ | ◎ |
| 5 | 7.72 | 6.32 | −14.03 | −14.21 | ◎ | ◎ |
| 6 | 16.53 | 3.89 | −14.16 | 2.34 | ◎ | ◎ |
| 7 | 6.65 | 12.48 | −4.36 | 12.31 | ◎ | ◎ |
| 8 | 13.62 | 6.48 | −8.07 | 2.78 | ◎ | ◎ |
| 9 | 3.28 | 2.04 | −12.08 | −8.38 | ◎ | ◎ |

TABLE 1-continued

| | Image 1 | | | | | |
|---|---|---|---|---|---|---|
| | When L* is about 80 | | When L is about 20 | | Image | Image |
| No. | a* | b* | a* | b* | 2 | 3 |
| 10 | 16.42 | −1.06 | −13.88 | −19.20 | ◎ | ◎ |
| 11 | 4.13 | 14.37 | −4.55 | 3.45 | ◎ | ◎ |
| 12 | 1.78 | 7.45 | −12.67 | 9.84 | ◎ | ◎ |
| 13 | 1.98 | 0.88 | −2.37 | −0.72 | ◎ | ◎ |
| 14 | 6.56 | −0.34 | −8.68 | −5.67 | ◎ | ◎ |

TABLE 2

| CONTINUED FROM TABLE 1 | | | | | | |
|---|---|---|---|---|---|---|
| | Image 1 | | | | | |
| | When L* is about 80 | | When L is about 20 | | Image | Image |
| No. | a* | b* | a* | b* | 2 | 3 |
| 15 | 4.22 | −0.08 | −7.79 | 1.18 | ◎ | ◎ |
| 16 | 2.11 | 5.87 | 2.34 | −4.21 | ○ | ○ |
| 17 | 7.63 | 9.05 | −2.54 | 16.28 | ○ | ○ |
| 18 | 12.28 | 3.96 | 6.23 | 3.84 | ○ | ○ |
| 19 | 13.10 | −2.33 | −0.86 | −13.56 | ○ | ○ |
| 20 | 16.73 | 8.29 | 11.45 | −3.66 | ○ | ○ |
| 21 | 2.22 | −1.76 | 0.54 | −1.84 | Δ | Δ |
| 22 | 4.48 | −1.66 | −13.42 | 8.30 | Δ | Δ |
| 23 | 10.28 | −4.22 | −0.67 | 0.22 | Δ | Δ |
| 24 | −8.31 | 6.03 | −2.65 | 1.73 | X | X |
| 25 | 3.65 | −8.56 | 5.59 | 3.67 | X | X |
| 26 | −6.73 | −3.21 | −2.21 | 4.40 | X | X |

Effects of First Embodiment

According to the medical image forming method of the present invention, since the tones of the three primary colors are compensated so that the density slope of light red of an image formed on an image receiving sheet in accordance with an image signal of light red is increased, namely, the low density region (light region of L*=80) of an image formed in accordance with an input of an achromatic color image signal becomes reddish and the high density region (dark region of L*=20) thereof becomes bluish green, the distinction of red which is the complementary of bluish green can be easily performed.

Second Embodiment

Basic Composition

Next, a second embodiment of the present invention will be described.

An example of a thermal transfer sheet 20 used in the second embodiment basically comprises a base film 22 and dye layers 21 for three primary colors like the first embodiment shown in FIG. 1. The dye layers 21 are disposed on the base film 22. The base film 22 of the thermal transfer sheet 20 according to the present invention can be any known material which has a heat resistance and hardness to some extent. For example, as the material of the base film 22, a paper, one of various processed papers, a polyester film, a polystyrene film, a polypropylene film, a polysulfone film, an aramid film, a polycarbonate film, a polyvinyl alcohol film, a cellophane, or the like can be used, the thickness thereof being preferably in the range from 0.5 to 50 μm, more preferably in the range from 3 to 10 μm. Most preferably, the base film 22 is a polyester film. The base film 22 can be either a cut type or a continuous film type. Each dye layer 21 formed on the front surface of the base film 22 is a layer where a corresponding dye is held by a corresponding binder resin.

Any dye which is known and used for conventional thermal transfer sheets can be used for each dye layer 21 as long as it can be effectively used for the present invention. Preferably, as the material of the red dye, MS Red G, Macrolex Red Violet R, Ceres Red 7B, Samaron Red HBSL, Resolin Red F3BS, or the like can be used. As the material of the yellow dye, Phorone Brilliant Yellow 6GL, PTY-52, Macrolex Yellow 6G, or the like can be used. As the material of the blue dye, Kayaset Blue 714, Waxoline Blue AP-FW, Foron Brilliant Blue S-R, MS Blue 100, or the like can be used.

As a binder resin which holds the above-mentioned dies, any known binder resin can be used. Preferably, as the material of the binder resin, a cellulose resin (such as ethyl cellulose, hydroxyethyl cellulose, ethylhydroxy cellulose, hydroxypropyl cellulose, methyl cellulose, acetic cellulose, or acetate butyric cellulose), a vinyl resin (such as polyvinyl alcohol, polyvinyl acetate, polyvinyl butyral, polyvinyl acetal, polyvinyl pyrrolidone, or polyacrylic amide), polyester, or the like can be used. Among these materials, a cellulose resin, an acetal resin, a butyral resin, a polyester resin, or the like is preferable from stand points of heat resistance and dye transfer property. In the dye layers, when necessary, various known additives can be contained.

Each dye layer 21 is produced in the following manner. An above-mentioned sublimating dye, an above-mentioned binder resin, a surface lubricant, and if necessary other components are added in a proper solvent so as to dissolve or disperse these components. Thus, a dye layer forming paint or a dye layer forming ink is made. This paint or ink is coated on the base film 22 and dried. The thickness of the dye layer 21 is preferably in the range from 0.2 to 5.0 μm, more preferably in the range from 0.4 to 2.0 μm. The amount of sublimating dye to be contained in the dye layer 21 is preferably in the range from 5 to 90% by weight of the dyeing layer, more preferably, in the range from 10 to 70% by weight thereof.

In addition, according to the present invention, an intermediate layer can be disposed between the base film 22 and the dye layers 21 so as to improve the adhesive property and cushioning property. For example, as the material of the intermediate layer, a polyurethane resin, an acrylic resin, a polyethylene resin, a butadiene rubber, an epoxy resin, or the like can be used. The thickness of the intermediate layer is preferably in the range from 0.1 to 5 μm. The intermediate layer can be formed in the same manner as the above-mentioned dye layers.

As an example of the image receiving sheet 30 for forming an image along with the thermal transfer sheet 20, any material can be used as long as the surface on the thermal transfer sheet side has a dye accepting property according to the above-mentioned dyes like the first embodiment shown in FIG. 1. For example, the image receiving sheet 30 comprises the base sheet 32 and the dye accepting layer 31 layered thereon. For example, as the material of the base sheet 32, a paper, a metal, a glass, a synthetic resin, or the like which does not have a dye accepting property can be used.

As a thermal energy applying means which is used for performing thermal transfer with the thermal transfer sheet 20 and the image receiving sheet 30, any known thermal energy applying means can be used. For example, by using a thermal printer with a thermal head 9 shown in FIG. 1 (for example, a video printer VY-100 made by Hitachi K. K.), the heating time of the thermal head is controlled so that thermal energy of 5 to 100 mj/mm$^2$ is applied to the image receiving sheet 30, thereby forming a desired image thereon. In other words, the thermal head 9 is driven and controlled by the control unit 10 in the same manner as the first embodiment shown in FIG. 1 so that the rear surface of the thermal transfer sheet 20 is heated for a predetermined time period.

As a preferable example of the thermal transfer sheet 20 according to the present invention, when the dye layers 21 of three primary colors (yellow, magenta, and cyan) are layered in succession on the base film 22, the dye of magenta is selected so that it has higher thermal transfer property than the dyes of yellow and cyan. With this thermal transfer sheet 20, when a color image is formed on an image receiving sheet 30 under the normal image forming condition in which the tone compensations of the first embodiment are not performed, the regions from orange to red of the color image are emphasized.

With the coating amount of solid component of dye layer 21 of yellow being in the range from 0.8 to 1.1 g/m$^2$, that of dye layer 21 of magenta being in the range from 0.6 to 0.9 g/m$^2$ and that of dye layer 21 of cyan from 1.0 to 1.5 g/m$^2$ when a color image is formed under the normal image forming conditions, the regions from orange to red of the color image are emphasized.

As a feature of colors of dye layers 21 composed of sublimating dyes, when the coating amount thereof is small, due to large thermal transfer rate an image can be formed with a small amount of thermal energy being applied. On the other hand, when the coating amount is large, although the amount of energy required for forming an image is larger than the above case, the maximum density becomes large. In other words, the colors of the dye layers and their maximum densities can be adjusted by the coating amount thereof. According to the present invention, when each dye layer is coated for the above-mentioned coating amount and a color image is formed under the normal image forming conditions, the regions from orange to red of the color image are emphasized.

EXAMPLE

Next, a practical example of the second embodiment will be described.

A heat resisting treatment was performed for the rear surface (opposite to the dye layer 21) of the base film 22 (a polyethylene terephthalate film with a thickness of 6 μm). The following dye forming inks with these components were made. Thereafter, the inks were coated on the front surface of the base film by gravure-printing technique and then dried. As a result, the thermal transfer sheet according to the present invention was produced.

Dye layer Ink A (cyan ink)

Dye: Kayaset Blue 714, made by Nippon Kayaku K. K. . . . 4.0 parts

Resin: Polyvinyl acetoacetal, KS-5D, made by Sekisui Kagaku K. K. . . . 4.0 parts Particles: Polyethylene wax, AF-31, made by BASF . . . 0.3 parts Solvent: Toluene/methyl-ethyl ketone (weight ratio 1/1) . . . 92.0 parts

Dye layer Ink B (magenta ink)

Dye: Baymicron VPSN 2670, made by Bayer . . . 0.3 parts

Resin: Polyvinyl acetoacetal, KS-5D, made by Sekisui Kagaku K. K. . . . 4.0 parts Particles: Polyethylene wax, AF-31, made by BASF . . . 0.3 parts Solvent: Toluene/methyl-ethyl ketone (weight ratio 1/1) . . . 93.0 parts

Dye layer Ink C (yellow ink)

Dye: Macrolex Yellow 6G, made by Bayer . . . 2 parts

Resin: Polyvinyl acetoacetal, KS-5D, made by Sekisui Kagaku K. K. . . . 3.0 parts Particles: Polyethylene wax, AF-31, made by BASF . . . 0.2 parts Solvent: Toluene/methyl-ethyl ketone (weight ratio 1/1) . . . 95.0 parts Next, as a base sheet 32, a synthetic paper Yupo (with a thickness of 150 μm) was used. Then, the following coating solution with these components for the accepting layer was coated on one surface of the base sheet 32 so that the amount of accepting layer dried became 4.5 g/m$^2$. Thereafter, the base sheet 32 was dried for 30 minutes at 100° C. As a result, an image receiving sheet 30 for use in the present invention and a comparison was obtained.

Composition of Coating Solution for Dye Accepting Layer

Polyester resin (Vylon 103, made by Toyobo K. K.) . . . 100.0 parts

Amino-denatured silicone oil (X-22-343, made by Shinetsu Kagaku Kogyo K. K.) . . . 0.5 parts Epoxy-denatured silicone oil (KF-393, made by Shinetsu Kagaku Kogyo K. K.) . . . 0.5 parts Toluene/methyl-ethyl ketone (weight ratio 1/1) . . . 500 parts The above-mentioned thermal transfer sheet 20 and the image receiving sheet 30 were layered so that the dye layers 21 of three colors were opposed to the dye accepting layer 31. With a thermal head 9 (KMT-85-6, MPD2), a thermal head recording was performed for the rear surface of the thermal transfer sheet 20 in the conditions where a head applying voltage is 12.0 V, a step pattern of applying pulse width starts from 16.0 msec/line with a decrement of 1 msec, and a scanning width is 6 lines/mm (33.3 msec/line). In this example, the reflection density of each step of the print image was measured with a density meter (Macbeth RD-918) so as to compare the thermal transfer property of the dyes of the dye layers 21.

In addition, with the above-mentioned thermal transfer sheet 20 and the image receiving sheet 30, under the control of a control unit 10 of a video printer (such as VY-200 made by Hitachi K. K. or UP-5000 made by Sony K. K.), image signals were input and evaluated.

Image 1: 64 tones of achromatic color

Image 2: Video input image of esophagus by endoscope

Image 3: Video input image of pyloric region of stomach by endoscope

Evaluation Method

Image 1 : With a spectral color difference meter CM-1000 (made by Minolta K. K.), the chromaticity values L*, a*, and b* of CIE for the image 1 were measured.

Images 2 and 3 : Under the following criteria, the images 2 and 3 were visually measured.

⊙: Very clear. Details of tissue could be easily distinguished.

○: Clear. Details of tissue could be distinguished.

Δ: Somewhat unclear. Details of tissue were distinguished with difficulty.

x: Completely unclear. Details of tissue could not be distinguished.

The results of this evaluation are shown in the following tables.

TABLE 3

EVALUATION BY VY-200

| No | Coating Amount (g/m²) | Comparison of Thermal Transfer Property | Image 1 When L* is about 80 a* | Image 1 When L* is about 80 b* | Image 1 When L* is about 20 a* | Image 1 When L* is about 20 b* | Image 2 | Image 3 |
|---|---|---|---|---|---|---|---|---|
| 1 | Ink A: 1.06 B: 0.60 C: 0.82 | When pulse width is 11 msec, $OD_B > OD_C > OD_A$ When pulse width is 5 msec, $OD_B > OD_C > OD_A$ | 7.43 | 12.62 | −4.17 | −1.35 | ⊙ | ⊙ |
| 2 | A: 1.25 B: 0.71 C: 0.92 | When pulse width is 11 msec, $OD_B > OD_A > OD_C$ When pulse width is 5 msec, $OD_B > OD_C > OD_A$ | 5.26 | 8.71 | −7.38 | −5.30 | ⊙ | ⊙ |
| 2 | A: 1.40 B: 0.87 C: 1.09 | When pulse width is 11 msec, $OD_B > OD_A > OD_C$ When pulse width is 5 msec, $OD_B > OD_C > OD_A$ | 3.06 | 4.67 | −5.54 | −7.22 | ⊙ | ⊙ |
| 4 | A: 1.06 B: 0.60 C: 1.09 | When pulse width is 11 msec, $OD_B > OD_A \geqq OD_C$ When pulse width is 5 msec, $OD_B > OD_C > OD_A$ | 9.91 | −0.72 | −3.48 | −5.34 | ○ | ○ |

TABLE 4

(CONTINUED FROM TABLE 3)

| | | | | | | | | |
|---|---|---|---|---|---|---|---|---|
| 5 | A: 1.40 B: 0.60 C: 0.82 | When pulse width is 11 msec, $OD_B > OD_C \geqq OD_A$ When pulse width is 5 msec, $OD_B > OD_C > OD_A$ | 11.06 | 14.31 | −4.19 | −3.79 | ○ | ○ |
| 6 | A: 1.06 B: 0.87 C: 1.09 | When pulse width is 11 msec, $OD_B \geqq OD_C > OD_A$ When pulse width is 5 msec, $OD_B \geqq OD_A > OD_C$ | 11.37 | −1.58 | −4.31 | 4.66 | Δ | Δ |
| 7 | A: 1.40 B: 0.87 C: 0.82 | When pulse width is 11 msec, $OD_B > OD_C \geqq OD_A$ When pulse width is 5 msec, $OD_B \geqq OD_C > OD_A$ | 5.94 | 14.23 | −6.02 | −8.33 | Δ | Δ |
| * | A: 1.06 B: 0.42 C: 0.82 | When pulse width is 11 msec, $OD_C > OD_A > OD_B$ When pulse width is 5 msec, $OD_B > OD_C > OD_A$ | 22.41 | 13.67 | −20.21 | 6.31 | X | X |
| 9 | A: 1.06 B: 1.23 C: 0.82 | When pulse width is 11 msec, $OD_B > OD_C > OD_A$ When pulse width is 5 msec, $OD_C > OD_A > OD_B$ | −1.52 | 3.39 | 17.65 | −10.62 | X | X |

TABLE 5

(CONTINUED FROM TABLE 3)

| | | | | | | | | |
|---|---|---|---|---|---|---|---|---|
| 10 | A: 1.06 B: 0.60 C: 0.62 | When pulse width is 11 msec, $OD_B > OD_A > OD_C$ When pulse width is 5 msec, $OD_C > OD_B > OD_A$ | 5.27 | 18.43 | −13.03 | −11.36 | X | X |
| 11 | A: 1.06 B: 0.60 C: 1.52 | When pulse width is 11 msec, $OD_C > OD_B > OD_A$ When pulse width is 5 msec, $OD_B > OD_A > OD_C$ | 10.86 | −4.31 | −0.75 | 1.24 | X | X |
| 12 | A: 0.72 B: 0.60 | When pulse width is 11 msec, $OD_B > OD_C \geqq OD_A$ | 6.35 | −10.35 | 1.13 | 3.87 | X | X |

TABLE 5-continued

| | | | | | | | |
|---|---|---|---|---|---|---|---|
| (CONTINUED FROM TABLE 3) | | | | | | | |
| C: 0.82 | When pulse width is 5 msec, $OD_A \geqq OD_B > OD_C$ | | | | | | |
| 13 A: 1.64 B: 0.60 C: 0.82 | When pulse width is 11 msec, $OD_A > OD_B > OD_C$ When pulse width is 5 msec, $OD_B > OD_C > OD_A$ | 11.97 | 16.34 | −4.50 | −8.91 | X | X |

where the thermal transfer comparisons ($OD_A$, $OD_B$, and $OD_C$) represent the reflection densities of step images in thermal head recording in accordance with the dye layer inks A, B, and C, respectively.

TABLE 6

| | | | EVALUATION BY UP-5000 | | | | | |
|---|---|---|---|---|---|---|---|---|
| | Coating | | Image 1 | | | | | |
| | Amount | Comparison of Thermal | When L* is about 80 | | When L* is about 20 | | Image | Image |
| No | (g/m²) | Transfer Property | a* | b* | a* | b* | 2 | 3 |
| 14 | | Same as No. 1 | 9.21 | 10.05 | −3.86 | −1.66 | ◎ | ◎ |
| 15 | | Same as No. 2 | 7.46 | 7.90 | −7.11 | −5.96 | ◎ | ◎ |
| 16 | | Same as No. 3 | 4.03 | 3.92 | −5.14 | −7.31 | ◎ | ◎ |
| 17 | | Same as No. 8 | 25.33 | 10.68 | −21.28 | 6.54 | X | X |
| 18 | | Same as No. 9 | −0.89 | 3.21 | 17.88 | −10.97 | X | X |
| 19 | | Same as No. 11 | 11.53 | −5.14 | −0.45 | 1.19 | X | X |
| 20 | | Same as No. 12 | 9.04 | −10.99 | 2.31 | 3.91 | X | X |

Effects of Second Embodiment

According to the present invention, since the dye layers of the transfer sheet are formed so that the light region and the dark region of an image formed on an image receiving sheet in accordance with an achromatic color supplied to the control unit are printed reddish and greenish respectively, medical images with color regions from light orange to light red which are easily distinguished can be formed.

Other Specific Example

Next, another specific example of the second embodiment will be described. In this practical example, dyes and binders which can compose dye layers of a thermal transfer sheet, binders which can compose a dye accepting layer of an image receiving sheet, and surface lubricants which can prevent the thermal transfer sheet and the image receiving sheet from thermally adhering each other will be described in detail. These materials will be described in the order of (1) dye binder, (2) dye accepting layer binder, (3) surface lubricant, and (4) dyes.

(1) Dye binder

For example, as the material of the binder of the dye layers, a cellulose derivative (such as ethyl cellulose, hydroxyethyl cellulose, ethylhydroxyethyl cellulose, methyl cellulose, acetate cellulose, acetate-butyrate cellulose, acetate propionic acid cellulose, or nitric acid cellulose), a vinyl resin (such as polyvinyl alcohol, polyvinyl acetate, polyvinyl butyral, polyvinyl acetoacetal, polyvinyl pyrrolidone, polystyrene, or polyvinyl chloride), a polyamide resin, a polyester resin, a poly-carbonate resin, an acrylic resin, a polyurethane resin, an elastomer, an epoxy resin, a phenoxy resin, a mixture thereof, or a copolymerization thereof can be used.

(2) Dye accepting binder

For example, as the material of the binder of the dye accepting layer, a cellulose derivative (such as ethyl cellulose, hydroxyethyl cellulose, ethyl-hydroxyethyl cellulose, methyl cellulose, acetate cellulose, acetate-butyrate cellulose, acetate propionic acid cellulose, or nitric acid cellulose), a vinyl resin (such as polyvinyl alcohol, polyvinyl acetate, polyvinyl butyral, polyvinyl acetoacetal, polyvinyl pyrrolidone, polystyrene, or polyvinyl chloride), a polyamide resin, a polyester resin, a poly-carbonate resin, an acrylic resin, a polyurethane resin, an elastomer, an epoxy resin, a phenoxy resin, a mixture thereof, or a copolymerization thereof can be used.

(3) Surface lubricant

To prevent the thermal transfer sheet containing the dye layers from thermally adhering to the image receiving sheet which accepts dyes, as the material of the surface lubricant, an inorganic particle (such as colloidal silica or titanium oxide), an organic particle (such as polyolefin wax or teflon powder), a higher fatty acid salt, a higher fatty acid ester, a surface active agent, a fluororesin, a silicone resin, or the like can be disposed in or on the thermal transfer sheet or the image receiving sheet.

(4) Dyes

For example, as the materials of the dyes, diaryl methane, triaryl methane, thiazole, methine (such as merocyanine), azomethine (such as indoaniline, acetophenone azomethine, pyrazolone azomethine, imidazole azomethine, pyrazolone azomethine, imidazo azomethine, or pyridone azomethine), xanthine, oxazine, cyano methylene (such as dicyano styrene or tricyano styrene), thiazine, azine, acridine, benzene azo, heterocyclic azo (such as pyridone azo, thiophene azo, isothiazole azo, pyrrole azo, pyrazole azo, imidazole azo, thiazole azo, triazole azo, or diazo), spiro-dipyran, indolinospiropyran, fluorene, rhodamine lactam, naphthoquimone, anthraquinone, quinophthalone, or the like can be used. Practically, the following dyes are preferably used.

C.I. (Color Index) C.I.

Disperse yellow: 51, 3, 54, 79, 60, 23, 7, 141, 201, and 261

Disperse blue: 24, 56, 14, 301, 334, 165, 19, 72, 87, 287 154, 26, and 354

Disperse red: 135, 146, 59, 1, 73, 60, and 167

Disperse violet: 4, 13, 26, 36, 56, and 31

Disperse orange: 149

Solvent violet: 13

Solvent black: 3

Solvent green: 3

Solvent yellow: 56 , 14, 16, and 29

(C.I. 52015), or the like]; or an anthraquinone basic dye having a class four ammonium group can be used.

For example, as the material of the cyan dye, Kayaset Blue 714 (made by Nippon Kayaku K. K., solvent blue 63), Foron Brilliant Blue S-R (made by Sand K. K., disperse blue 345), or Waxoline AP-FW (made by ICI, solvent blue 36) can be selected. For example, as the material of the magenta dye, MS-RED G (made by Mitsui Toatsu K. K., disperse red 60), or Macrolex Red Violet R (made by Bayer, disperse violet 26) can be used. For example, as the material of the yellow dye, Foron Brilliant Yellow S-6GL (made by Sand, disperse yellow 231), Macrolex Yellow 6G (made by Bayer, disperse yellow 201), or a compound having the following composition can be used.

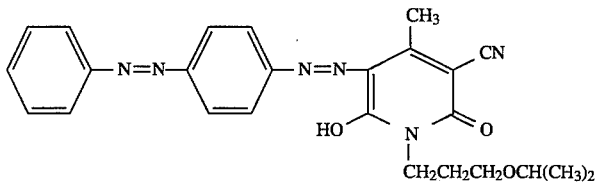

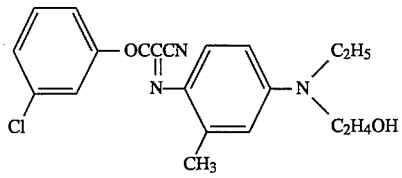

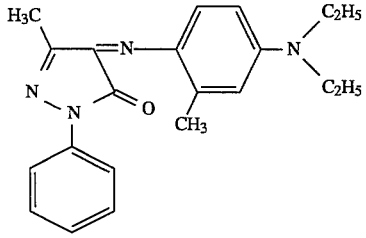

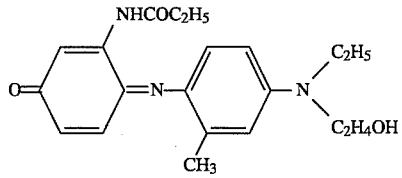

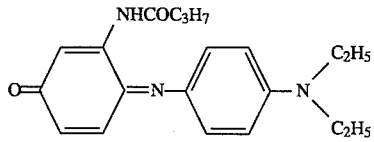

Solvent blue: 70, 35, 63, 36, 50, 49, 111, 105, 97, and 11
Solvent red : 135, 81, 18, 25, 19, 23, 24, 143, 146, 182, and the like.

More specifically, as the materials of the dyes, a metine (cyanine) basic dye of mono-methine, di-methine, tri-methine, or the like [such as 3, 3'-diethyloxathiacyanine iodide Astrazone Pink FG (made by Bayer, C.I. 48015), 2,2' carbocyanine (C.I. 808), Astraphylloxine FF (C.I. 48070), Astrazone Yellow 7GLL (C.I. basic yellow 21), Aizen Kachiron Yellow 3GLH (made by Hodogaya Kagaku K. K., C.I. 48055), Aizen Kachiron Red 6BH (C.I. 48020) or the like]; a di-phenylmethane basic dye [such as auramin (C.I. 655)]; a triphenylmethane basic dye [such as Malachite Green (C.I. 42000), Brilliant Green (C.I. 42040), Magenta (C.I. 42510), Metal Violet (C.I. 42535), Crystal Violet (C.I. 42555), Methyl Green (C.I. 684), Victoria Blue B (C.I. 44045), or the like]; a xanthene basic dye [such as Pyronine G (C.I. 739), Rhodamine B (C.I. 45170), Rhodamine 6G (C.I. 45160), or the like]; an acridine basic dye [such as Acridine Yellow G (C.I. 785), Leonine AL (C.I. 46075), Benzo-Flavin (C.I. 791), Affine (C.I. 46045) or the like]; a quinoneimine basic dye [such as Neutral Red (C.I. 50040), Astrazone Blue BGE/x 125% (C.I. 51005), Methylene Blue Moreover, the sublimating yellow dyes described in Japanese Patent Laid-Open Serial Nos. SHO 59-78895, 60-28451, 60-28453, 60-53564, 61-148096, 60-239290, 60-31565, 60-30393, 60-53563, 60-27594, 61-262191, 60-152563, 61-244595, 62-196186, International Laid-Open Ser. No. W092/05032 can be suitably used. The sublimating magenta dyes described in Japanese Patent Laid-Open Serial Nos. SHO 60-223862, 60-28452, 60-51563, 59-78896, 60-31564, 60-30391, 61-227092, 61-227091, 60-30392, 60-30394, 60-131293, 61-227093, 60-159091, 61-262190, and U.S. Pat. No. 4,698,651, Japanese Patent Application Serial No. SHO 62-220793, and U.S. Pat. No. 5,079,365 can be suitably used. The sublimating cyan dyes described in Japanese Patent Laid-Open Serial Nos. SHO 59-78894, 59-227490, 60-151098, 59-227493, 61-244594, 59-227948, 60-131292, 60-172591, 60-151097, 60-131294, 60-217266, 60-31559, 60-53563, 61-255897, 60-239289, 61-22993, 61-19396, 61-268493, 61-35994, 61-31467, 61-145269, 61-49893, 61-57651, 60-239291, 60-239292, 61-284489, 62-191191, Japanese Patent Application Ser. No. SHO 62-176625, and U.S. Pat. No. 5,079,365 can be also suitably used.

Example of more preferable dyes are given by the following structural formulas.

general chemical formula 1

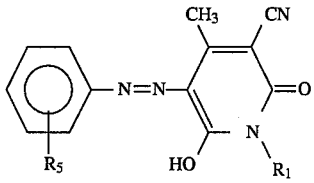

general chemical formula 2

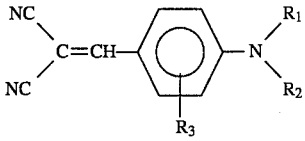

general chemical formula 3

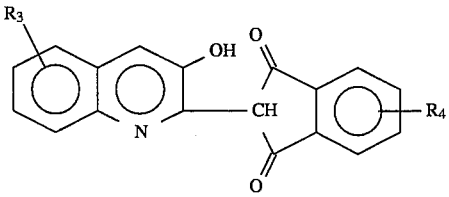

general chemical formula 4

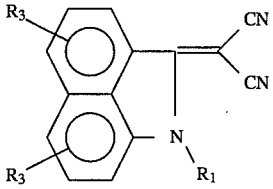

general chemical formula 5

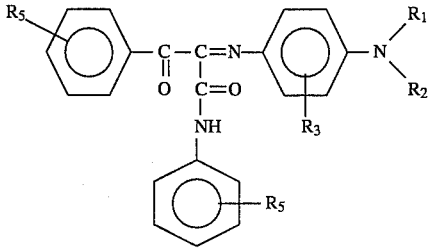

general chemical formula 6

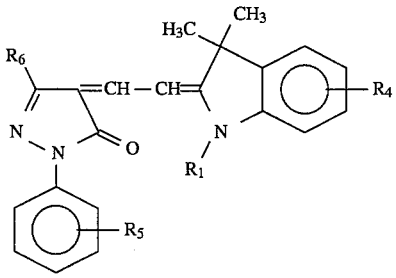

general chemical formula 7

-continued

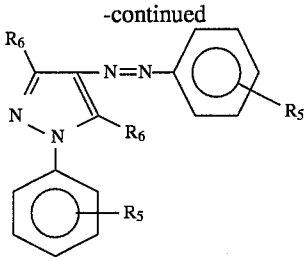

general chemical formula 8

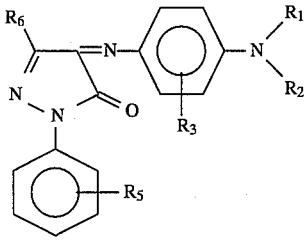

general chemical formula 9

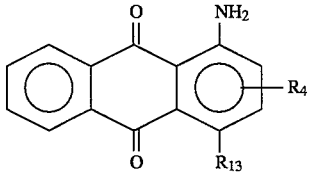

general chemical formula 10

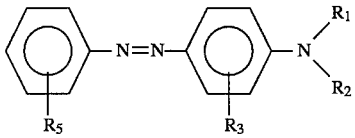

general chemical formula 11

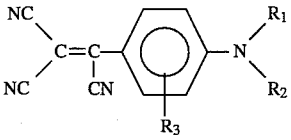

general chemical formula 12

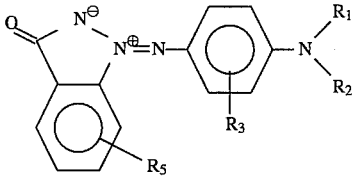

general chemical formula 13

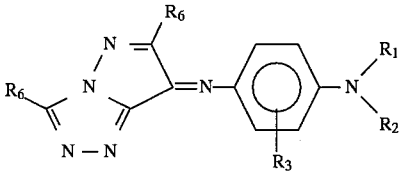

general chemical formula 14

-continued

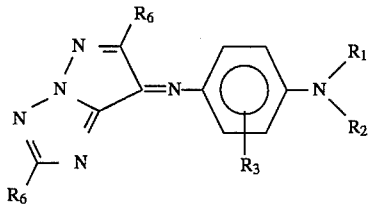

general chemical formula 15

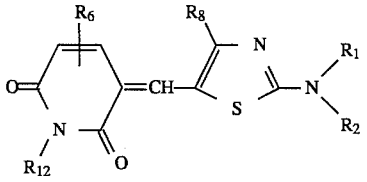

general chemical formula 16

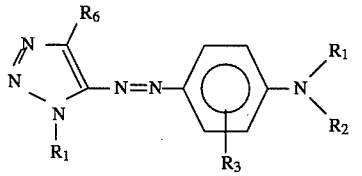

general chemical formula 17

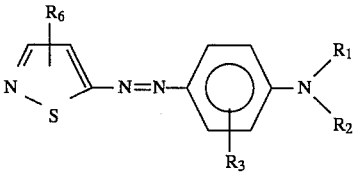

general chemical formula 18

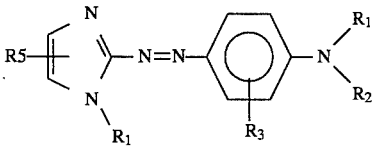

general chemical formula 19

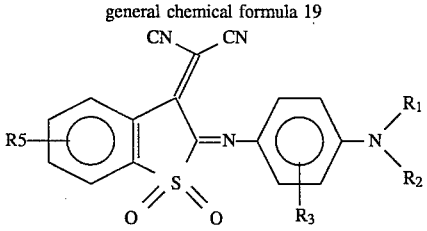

general chemical formula 20

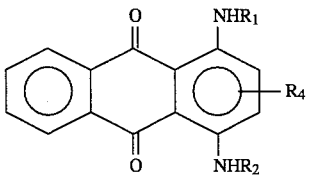

general chemical formula 21

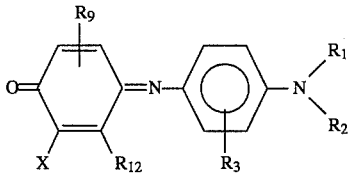

-continued general chemical formula 22

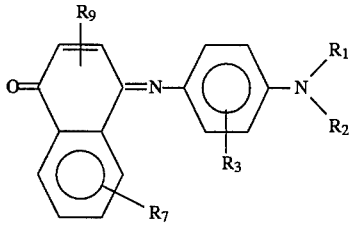

general chemical formula 23

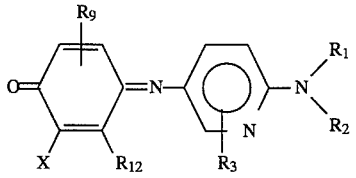

general chemical formula 24

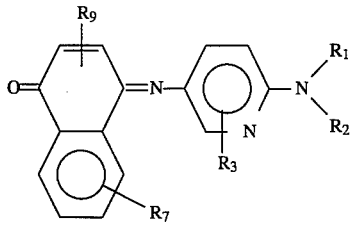

general chemical formula 25

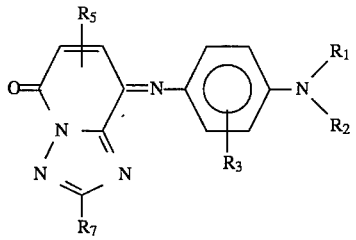

general chemical formula 26

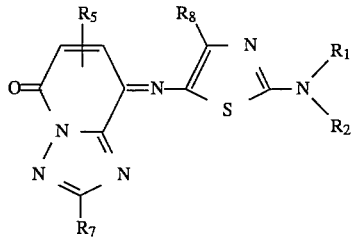

general chemical formula 27

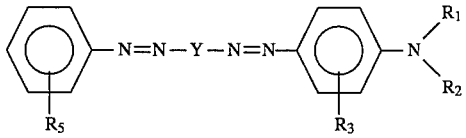

general chemical formula 28

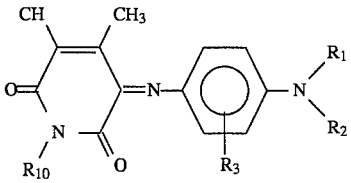

where

R1 and R2 are an alkyl group which is substitutable or non-substitutable, a cycloalkyl group which is substitutable or non-substitutable, or an aralkyl group which is substitutable or non-substitutable;

R3 is an alkyl group which is substitutable or non-substitutable, an alkoxy group which is substitutable or non-substitutable, an akkylcarbonyl-amino group which is substitutable or non-substitutable, an alkylsulfonylamino group which is substitutable or non-substitutable, an alkylaminocarbonyl group which is substitutable or non-substitutable, an alkylaminosulfonyl group which is substitutable or non-substitutable, or a halogen atom;

R4 is an alkoxy-carbonyl group which is substitutable or non-substitutable, an alkylaminocarbonyl group which is substitutable or non-substitutable, an alkoxy group which is substitutable or non-substitutable, an alkyl group which is substitutable or non-substitutable, a cycloalkyl group which is substitutable or non-substitutable, a heterocyclic group, or a halogen atom;

R5 is an alkyl group which is substitutable or non-substitutable, an alkoxycarbonyl group which is substitutable or non-substitutable, an alkylaminocarbonyl group which is substitutable or non-substitutable, an alkoxy group which is substitutable or non-substitutable, an alkylaminosulfonyl group which is substitutable or non-substitutable, a cyano group, a nitro group, or a halogen atom;

R6 is an alkyl group which is substitutable or non-substitutable, an aryl group which is substitutable or non-substitutable, an amino group which is substitutable or non-substitutable, a cycloalkyl group which is substitutable or non-substitutable, a cyano group, a nitro group, or a halogen atom;

R7 is an alkyl group which is substitutable or non-substitutable, an amino group which is substitutable or non-substitutable, an alkoxy group which is substitutable or non-substitutable, an alkoxycarbonyl group, or a halogen atom;

R8 is an aryl group which is substitutable or non-substitutable, an aromatic heterocyclic group, a cyano group, a nitro group, a halogen atom, or an electron attracting group;

R9 is selected from the group consisting of $CONHR_{10}$, $SO_2NHR_{10}$, $NHCOR_{11}$, $NHSO_2R_{11}$, or a halogen atom;

R10 is an alkyl group which is substitutable or non-substitutable, a cycloalkyl group which is substitutable or non-substitutable, an aryl group which is substitutable or non-substitutable, or an aromatic heterocyclic group which is substitutable or non-substitutable; and R11 is an alkyl group which is substitutable or non-substitutable, a cycloalkyl group which is substitutable or non-substitutable, an amino group which is substitutable or non-substitutable, an aryl group which is substitutable or non-substitutable, or an aromatic heterocyclic group which is substitutable or non-substitutable.

These dyes can be used independently or in mixtures thereof. In addition, known dyes which are transferred by thermal sublimation, vaporization, or dispersion can be added.

Although the present invention has been shown and described with respect to a best mode embodiment thereof, it should be understood by those skilled in the art that the foregoing and various other changes, omissions, and additions in the form and detail thereof may be made therein without departing form the spirit and scope of the present invention.

What is claimed is:

1. A medical image forming apparatus, comprising:

a heating device for applying heat, in accordance with image information, to a thermal transfer sheet disposed on an image receiving sheet, so as to form a full color image on the image receiving sheet, the thermal transfer sheet having a base film and three color dye layers of yellow, magenta and cyan, each of the dye layers being composed of a dye and a binder; and control unit means for driving and controlling said heating device in accordance with an input achromatic color image signal, wherein said control unit means compensates tones of the image represented by said input achromatic color image signal so that the chromaticity value of said full color image formed on the image receiving sheet is in a region defined by four points of ($a^*=0$, $b^*=0$), ($a^*=20$, $b^*=-5$), ($a^*=18$, $b^*=15$), and ($a^*=0$, $b^*=15$), when $L^*=80$.

2. The medical image forming apparatus of claim 1, wherein said control unit means comprises:

an input terminal for receiving an image signal;

a matrix circuit for decomposing said image signal into color components of three primary colors of yellow, magenta and cyan on a pixel-by-pixel basis;

a plurality of frame memories for storing the decomposed color components;

a pulse width modulating circuit for reading compensation data according to these colors from a pulse width memory;

a color selecting switch for selecting one of said frame memories to be connected to said pulse width modulating circuit; and an output portion for sending a signal of said pulse width modulating circuit to said heating device.

3. A medical image forming apparatus, comprising:

a heating device for applying heat, in accordance with image information, to a thermal transfer sheet disposed on an image receiving sheet, so as to form a full color image on the image receiving sheet, the thermal transfer sheet having a base film and three color dye layers of yellow, magenta and cyan, each of the dye layers being composed of a dye and a binder; and control unit means for driving and controlling said heating device in accordance with an input achromatic color image signal, wherein said control unit means compensates tones of the image represented by said input achromatic color image signal so that the chromaticity value of said full color image formed on the image receiving sheet is in a region defined by four points of ($a^*=0$, $b^*=20$), ($a^*=0$, $b^*=-10$), ($a^*=-20$, $b^*=-20$), and ($a^*=-20$, $b^*=15$), when $L^*=20$.

4. The medical image forming apparatus of claim 3, wherein said control unit means comprises:

an input terminal for receiving an image signal;

a matrix circuit for decomposing said image signal into color components of three primary colors of yellow, magenta and cyan on a pixel-by-pixel basis;

a plurality of frame memories for storing the decomposed color components;

a pulse width modulating circuit for reading compensation data according to these colors from a pulse width memory;

a color selecting switch for selecting one of said frame memories to be connected to said pulse width modulating circuit; and an output portion for sending a signal of said pulse width modulating circuit to said heating device.

* * * * *